US012656094B2

(12) United States Patent
Kinney et al.

(10) Patent No.: US 12,656,094 B2
(45) **Date of Patent: *Jun. 16, 2026**

(54) AMMUNITION PRESS AND COMPONENTS THEREOF

(71) Applicant: AOB Products Company, Columbia, MO (US)

(72) Inventors: Timothy S. Kinney, Warrenton, MO (US); James Tayon, Moberly, MO (US); Michael Cottrell, Ashland, MO (US); Dennis W. Cauley, Jr., Fayette, MO (US); Justin Burke, Columbia, MO (US); Brian Steere, Columbia, MO (US); Kyle Martin, Columbia, MO (US); Anthony Vesich, Columbia, MO (US); Matthew Kinamore, Columbia, MO (US); Joel Yuodsnukis, Columbia, MO (US); Curtis Smith, Columbia, MO (US); Mark Dalton, Columbia, MO (US)

(73) Assignee: AOB Products Company, Columbia, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/772,781

(22) Filed: Jul. 15, 2024

(65) Prior Publication Data

US 2024/0369334 A1 Nov. 7, 2024

Related U.S. Application Data

(60) Continuation of application No. 17/650,423, filed on Feb. 9, 2022, now Pat. No. 12,038,260, which is a (Continued)

(51) Int. Cl.
*F42B 33/00* (2006.01)
*F42B 33/10* (2006.01)

(52) U.S. Cl.
CPC ..... *F42B 33/002* (2013.01); *F42B 33/001* (2013.01); *F42B 33/10* (2013.01)

(58) Field of Classification Search
CPC ..... F42B 33/001; F42B 33/004; F42B 33/04; F42B 33/10
See application file for complete search history.

(56) References Cited

U.S. PATENT DOCUMENTS 1,864,880 A 6/1932 Zimmerman
1,978,130 A 10/1934 Gairing
(Continued)

FOREIGN PATENT DOCUMENTS

DE 4008382 A1 9/1991

OTHER PUBLICATIONS

Amazon.com: KMS Squared UFO 550 Reloading Press Light—Kit: Sports & Outdoors, Aug. 16, 2021, 7 pages.
(Continued)

*Primary Examiner* — Jonathan C Weber
(74) *Attorney, Agent, or Firm* — Stinson LLP

(57) ABSTRACT

An ammunition press for manufacturing or reloading ammunition cartridges. The ammunition press includes an adjustable shell holder for holding ammunition shells (sometimes called cases) of various sizes. A catch tray is provided for collecting spent primers or other debris. According to a user's preference, the ammunition press can be customized to provide an over-center actuated configuration or a non-over-center actuated configuration. A light is integrated with the press for illuminating the shell holder. Components of the press and associated methods are also disclosed.

18 Claims, 16 Drawing Sheets

Related U.S. Application Data continuation of application No. 17/650,297, filed on Feb. 8, 2022, now Pat. No. 12,038,259, which is a continuation of application No. 17/128,136, filed on Dec. 20, 2020, now Pat. No. 11,274,909, which is a division of application No. 16/281,224, filed on Feb. 21, 2019, now Pat. No. 10,900,762.

(56) References Cited

U.S. PATENT DOCUMENTS

| | | | |
|---|---|---|---|
| 2,680,988 | A | 6/1954 | Watson |
| 2,800,830 | A | 7/1957 | Gerstenberger |
| 3,025,743 | A | 3/1962 | Cecchi |
| 3,054,322 | A | 9/1962 | Corcoran |
| 3,107,575 | A | 10/1963 | Paul |
| 3,157,086 | A | 11/1964 | Bachhuber |
| 3,175,456 | A | 3/1965 | Goodsell |
| 3,242,790 | A | 3/1966 | Bachhuber |
| 3,313,201 | A | 4/1967 | Lawrence |
| 3,319,511 | A | 5/1967 | McLean |
| 3,345,903 | A | 10/1967 | Purdie |
| 3,349,663 | A | 10/1967 | Slee |
| 3,603,199 | A | 9/1971 | Corcoran |
| 3,818,563 | A | 6/1974 | Beaulieu |
| 3,916,758 | A | 11/1975 | Ashbrook |
| 4,020,737 | A | 5/1977 | Ranson |
| 4,078,472 | A | 3/1978 | Simpson |
| 4,202,245 | A | 5/1980 | McSpadden |
| 4,331,063 | A | 5/1982 | Schaenzer |
| 4,393,744 | A | 7/1983 | Lee |
| 4,418,606 | A | 12/1983 | Lee |
| 4,425,833 | A | 1/1984 | Purdie |
| 4,512,235 | A | 4/1985 | Lee et al. |
| 4,515,063 | A | 5/1985 | Lee |
| 4,522,102 | A | 6/1985 | Pickens |
| 4,615,255 | A | 10/1986 | Carter |
| 4,620,472 | A | 11/1986 | Dillon |
| 4,637,291 | A | 1/1987 | Alexander |
| 4,766,798 | A | 8/1988 | David et al. |
| 4,817,491 | A | 4/1989 | Fenton |
| 4,890,534 | A | 1/1990 | Bender |
| 5,221,806 | A | 6/1993 | Chaney et al. |
| 5,313,869 | A | 5/1994 | Lee |
| 5,394,785 | A | 3/1995 | Wood |
| 5,635,661 | A | 6/1997 | Tuftee |
| 5,693,905 | A | 12/1997 | Blodgett |
| 5,837,916 | A | 11/1998 | Noakes, Jr. |
| 5,932,828 | A | 8/1999 | Hornady et al. |
| 6,484,916 | B1 | 11/2002 | Salom et al. |
| 7,650,825 | B1 | 1/2010 | Lee et al. |
| 8,234,963 | B2 | 8/2012 | Lee |
| 9,127,919 | B2 | 9/2015 | Holland |
| 9,267,775 | B1 | 2/2016 | Kleinschmit |
| 9,846,018 | B1 | 12/2017 | Schloer |
| 10,076,781 | B1 | 9/2018 | Lee |
| 10,267,609 | B1 | 4/2019 | Richardson et al. |
| 11,204,226 | B1 | 12/2021 | Lee |
| 11,353,306 | B1 | 6/2022 | Bach |
| 11,913,763 | B2 | 2/2024 | Ball |
| 2004/0025677 | A1 | 2/2004 | Koch et al. |
| 2006/0180011 | A1 | 8/2006 | Benn |
| 2006/0180012 | A1 | 8/2006 | Benn |
| 2009/0229338 | A1 | 9/2009 | Von Lengeling |
| 2012/0204706 | A1 | 8/2012 | Duneman |
| 2015/0053071 | A1 | 2/2015 | Holland |

OTHER PUBLICATIONS

Ulitimate Reloader, "Frankford Arsenal M-Press (New): Uboxing and Complete Overview," Jan. 12, 2019, YouTube, Entire Video, <https://www.youtube.com/watch?v=sBZP4uMN_LY>. (Year: 2019).

Armatis Reviews, "Inline Fabrication Skylight LED Light Installation and Overview," Nov. 27, 2017, Youtube, Entire Video <https://www.youtube.com/watch?v+-2LAkiPuQTY. (Year: 2017).

Instruction Manual, Lee Load-Master, 2015, Lee Precision, Inc., 4275 Hwy U, Hartford, WI, www.leeprecision.com, 8 pages.

AMMUNITION PRESS AND COMPONENTS THEREOF

CROSS-REFERENCE TO RELATED APPLICATIONS

This application is a continuation of U.S. patent application Ser. No. 17/650,423, filed Feb. 9, 2022, which is a continuation of U.S. patent application Ser. No. 17/650,297, filed Feb. 8, 2022, which is a continuation of U.S. patent application Ser. No. 17/128,136, filed Dec. 20, 2020, now U.S. Pat. No. 11,274,909, issued Mar. 15, 2022, which is a divisional of U.S. patent application Ser. No. 16/281,224, filed Feb. 21, 2019, now U.S. Pat. No. 10,900,762, issued Jan. 26, 2021, the entireties of which are hereby incorporated by reference.

FIELD

The present disclosure generally relates to ammunition accessories, and more particularly to a press for manufacturing or reloading ammunition and components of such a press.

BACKGROUND

When loading or reloading ammunition, an ammunition press is commonly used to perform various operations. Ammunition presses can have various configurations. In many instances, a die is mounted on the press, and a lever actuated ram having a shell holder holding an ammunition shell (sometimes called a case) is used to move the shell into engagement with the die to perform an operation on the shell. For example, the shell may be moved into a sizing or resizing die to size the shell to desired dimensions. As another example, the shell may be moved into engagement with a decapping die for pushing a spent primer out of the shell.

SUMMARY

In one aspect, a case holder for holding an ammunition case comprises a frame including a bed configured to support an end of the ammunition case. A first jaw is supported by the frame and configured to engage the ammunition case to hold the ammunition case. The first jaw has a first jaw member on a first side of the first jaw and has a second jaw member on a second side of the first jaw. The first jaw is mounted for rotation about an axis of rotation with respect to the bed to selectively present one of the first and second jaw members in a case engagement position to engage the ammunition case for holding the ammunition case.

In another aspect, an ammunition press comprises a base configured to engage a support surface to support the ammunition press on the support surface. A die holder is supported by the base and configured to hold a die for ejecting a spent primer from an ammunition case. A ram is supported by the base and movable toward the die holder to move an ammunition case toward the die holder. A spent primer catch tray having an upper opening is supported by and movable with the ram, the spent primer catch tray located in an operational position with respect to the ram in which the ram covers the upper opening of the spent primer catch tray. The ram includes a spent primer opening arranged to permit a spent primer to fall into the spent primer catch tray from the ammunition case when the spent primer catch tray is in the operational position.

In yet another aspect, an ammunition press comprises a frame having a base configured to engage a support surface to support the ammunition press on the support surface. A die holder is supported by the frame and configured to hold a die for performing an operation on an ammunition case. A driver is supported by the frame and movable with respect to the frame to engage an ammunition case with the die holder. The driver includes a ram, a linkage, and a lever. The ram is movable between a home position and a pressing position for engaging the ammunition case with a die on the die holder. The lever is pivotable with respect to the frame in an actuating direction from a non-actuated position to an actuated position in which the lever is prevented from further pivoting in the actuating direction. The linkage is connected to the lever such that pivoting of the lever in the actuating direction toward the actuated position moves the ram toward the pressing position. The driver is adjustable to change the actuated position of the lever in which the lever is prevented from further pivoting in the actuating direction.

Other objects and features of the present invention will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
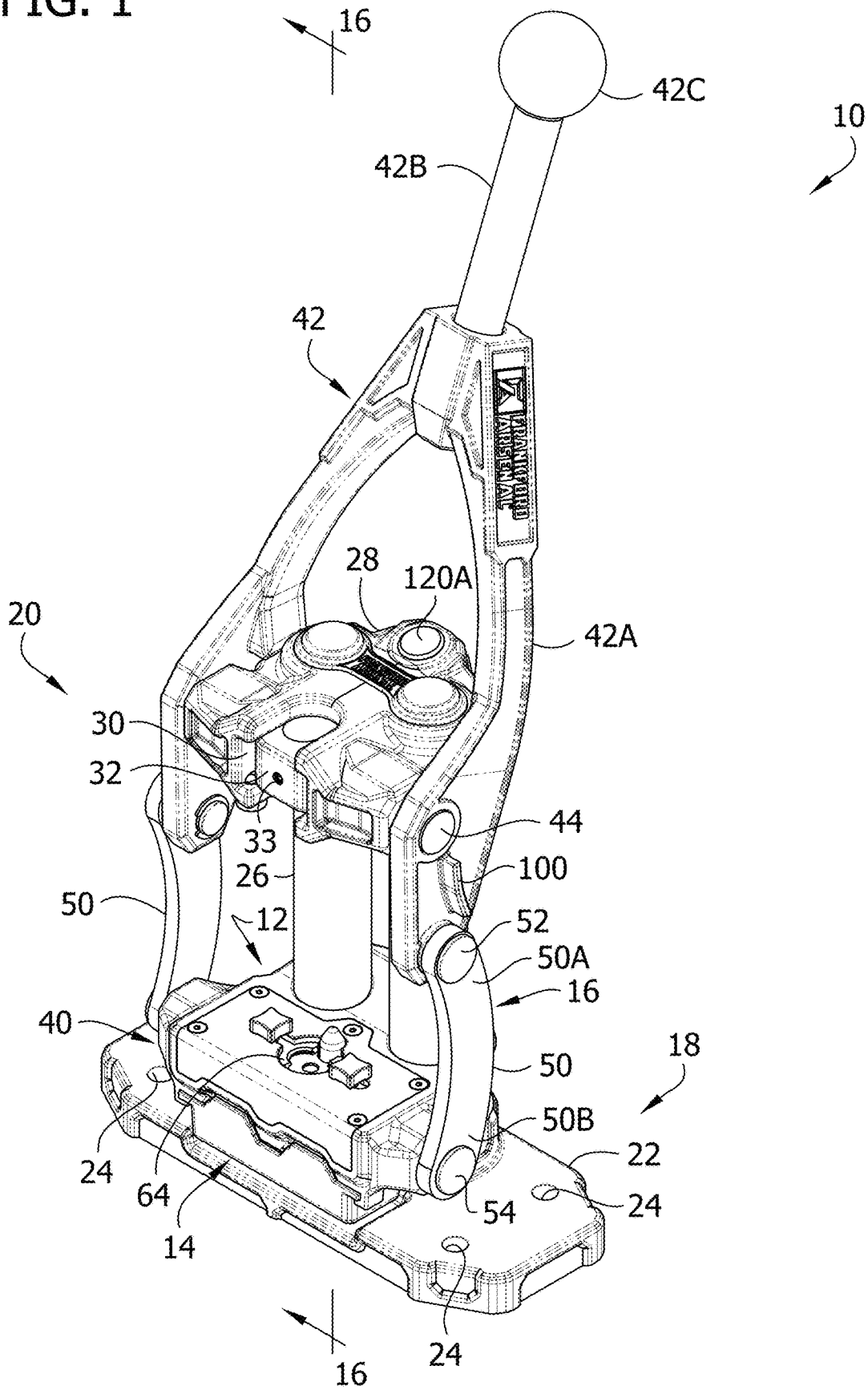
FIG. 1 is a perspective of an ammunition press of the present disclosure, the ammunition press shown in a non-actuated configuration.

Referring to FIG. 1, an ammunition press embodying aspects of the present disclosure is indicated generally by the reference number 10. The press can be used to perform various operations on an ammunition case (also known as an ammunition shell or casing). The ammunition press 10 is believed to include several improvements over prior ammunition presses. As will be explained in further detail below, the press 10 includes an easily adjustable case holder 12 for holding ammunition cases of different diameters, a spent primer catch tray 14 for collecting spent primers ejected from ammunition cases, and an adjustable linkage 16 for changing whether the user feels a "cam over" sensation or not when the press is fully actuated. In addition, the press 10 includes an integrated light for illuminating portions of the press.

Referring to FIG. 1, the press 10 includes a frame 18 and an ammunition case drive assembly 20. The frame 18 provides support to the ammunition case drive assembly 20. In use, the frame 18 remains generally stationary, and the ammunition case drive assembly 20 moves with respect to the frame for moving the case toward a stationary die.

The frame 18 includes a base 22 having a bottom surface adapted for engaging a table top or a bench top for supporting the ammunition press on the support surface. Four openings 24 are provided in the base 22 for bolting the base to the table top, bench top, or other support. The frame 18 further includes two columns 26 extending upward from the base 22 and a head 28 mounted on upper ends of the columns. The columns 26 are cylindrical shafts that support the ammunition case drive assembly 20 and guide movement of the drive assembly. The press 10 includes a die holder 30 at the head 28 for holding various types of dies. For example, a sizing die (not shown) configured to shape a neck of the ammunition case can be supported by the die holder 30. The sizing die can include a pin configured to eject a spent primer from the ammunition case. The die holder 30 comprises a receiver configured to laterally receive a collar 32. The collar has a threaded opening and is threadable onto the die. A set screw 33 can be threaded into the collar to fix the position of the collar on the die. The collar 32 is usually threaded onto the die apart from the press 10, and then the collar on the die is moved laterally into the die holder 30, which captures the collar and thus holds the die in position so ammunition cases can be moved by the press into engagement with the die. It will be appreciated that other frames and other die holders can be used without departing from the scope of the present invention.

The ammunition case drive assembly 20 (broadly "driver") includes a ram 40, a lever 42, and the linkage 16 connecting the lever to the ram. The lever 42 is pivotable to move the ram 40 toward the die holder 30 to engage an ammunition case with the die held by the die holder. The lever 42 includes a yoke 42A pivotally connected to opposite sides of the head 28 at pin connections 44. The lever 42 includes an arm 42B extending away from the yoke 42A and a knob 42C connected to a distal end of the arm. The lever 42 is shown in a non-actuated position in FIG. 1 and in an actuated position in FIG. 2. In the illustrated embodiment, the lever 42 is pivotable in an actuating direction by pulling the lever downward from the non-actuated position to the actuated position. As explained in further detail below, in the actuated position, the lever 42 is prevented from pivoting further in the actuating direction, and the drive assembly 20 is adjustable to change the actuated position where further pivoting of the lever is prevented. It will be appreciated that the drive assembly (e.g., lever, linkage, ram) could be configured to move the die toward a stationary case holder without departing from the scope of the present invention.

Figure 12:
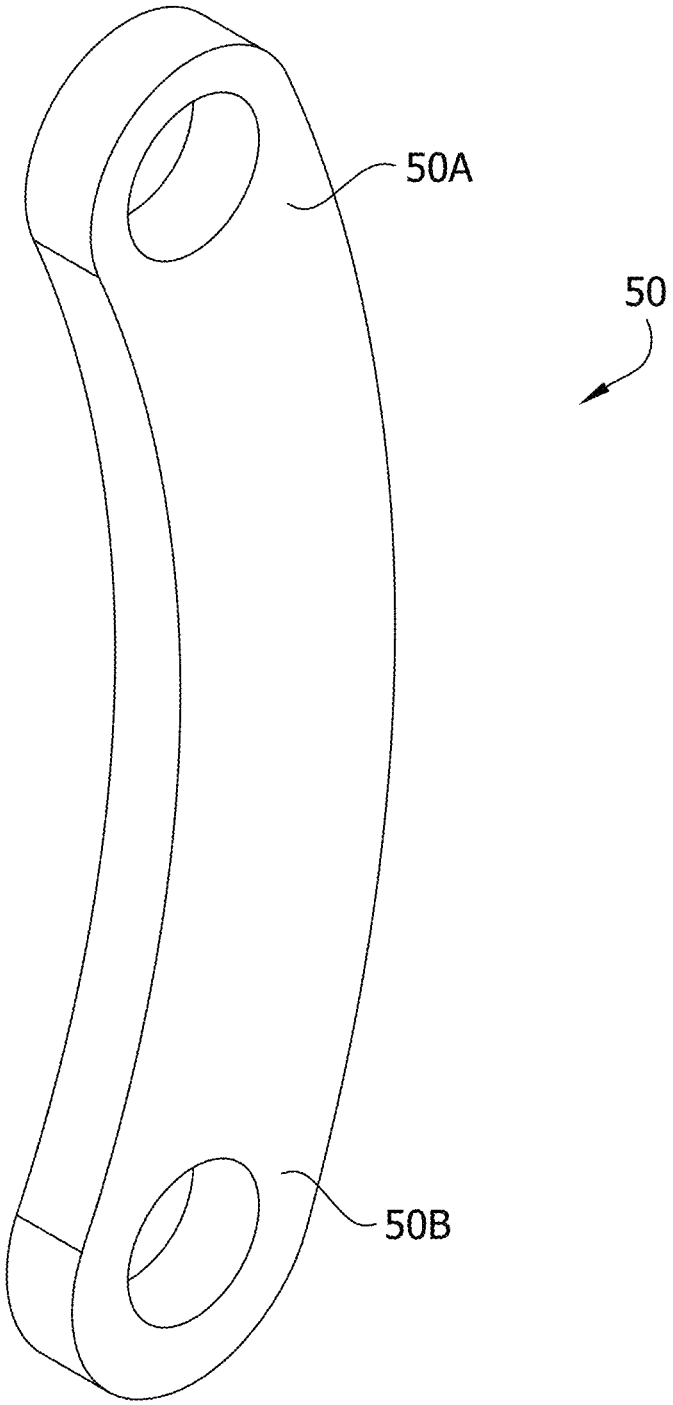
FIG. 12 is a perspective of a linkage arm of the press.

The linkage 16 includes left and right links 50. The left and right links 50 have upper end portions 50A pivotally connected to the yoke 42A by pins 52. The links 50 have lower end portions 50B pivotally connected to the ram by pins 54. The links 50 convert pivoting movement of the lever 42 to linear travel of the ram 40 toward and away from the die holder 30. As shown in FIGS. 3 and 13-15, the links 50 each include a link axis LA extending between pivot axes PA1, PA2 defined by the respective pin connections. For reasons which will become apparent, the links 50 are asymmetrical. As shown in FIG. 12, the upper end portions 50A of the links are smaller than the lower end portions 50B of the links, and the link bodies curve between the upper and lower end portions of the links, rather than extend in a straight line between the upper and lower end portions.

Figure 2:
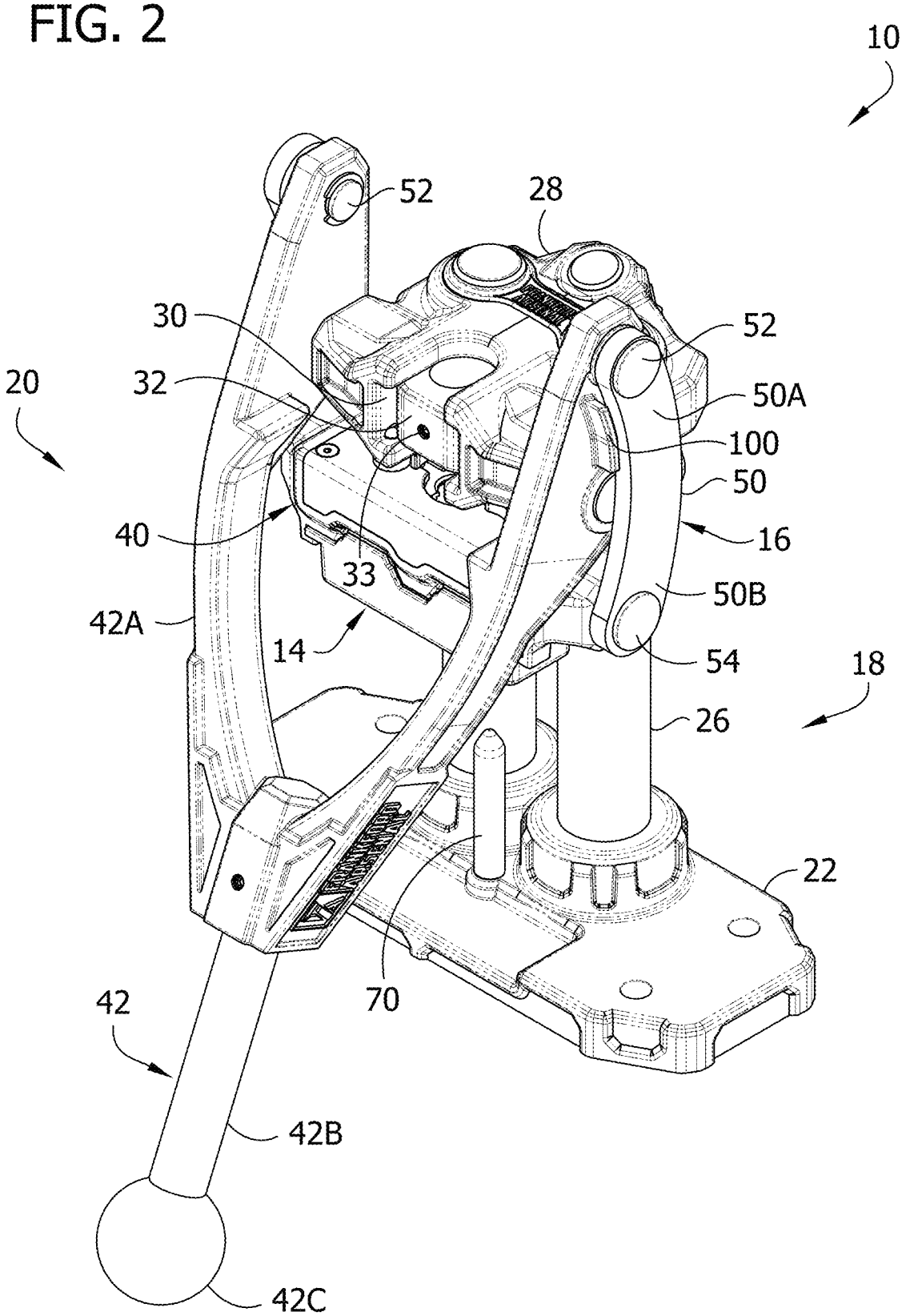
FIG. 2 is a perspective of the ammunition press in an actuated configuration.

The ram 40 is movable by the lever 42 between a home position shown in FIG. 1 and a "pressing" position shown in FIG. 2. It will be understood that the ram 40 is moved toward the pressing position to press an ammunition case against a die on the die holder 30. In use, an ammunition case is supported on the ram 40, the ram is moved toward the pressing position to engage the case with the die, and then the ram is moved back to the home position. The ammunition case is removed from the ram 40 and the process is repeated with another ammunition case. The ram 40 is repeatedly moved between the home and pressing positions to press several ammunition cases against the die.

Figure 3:
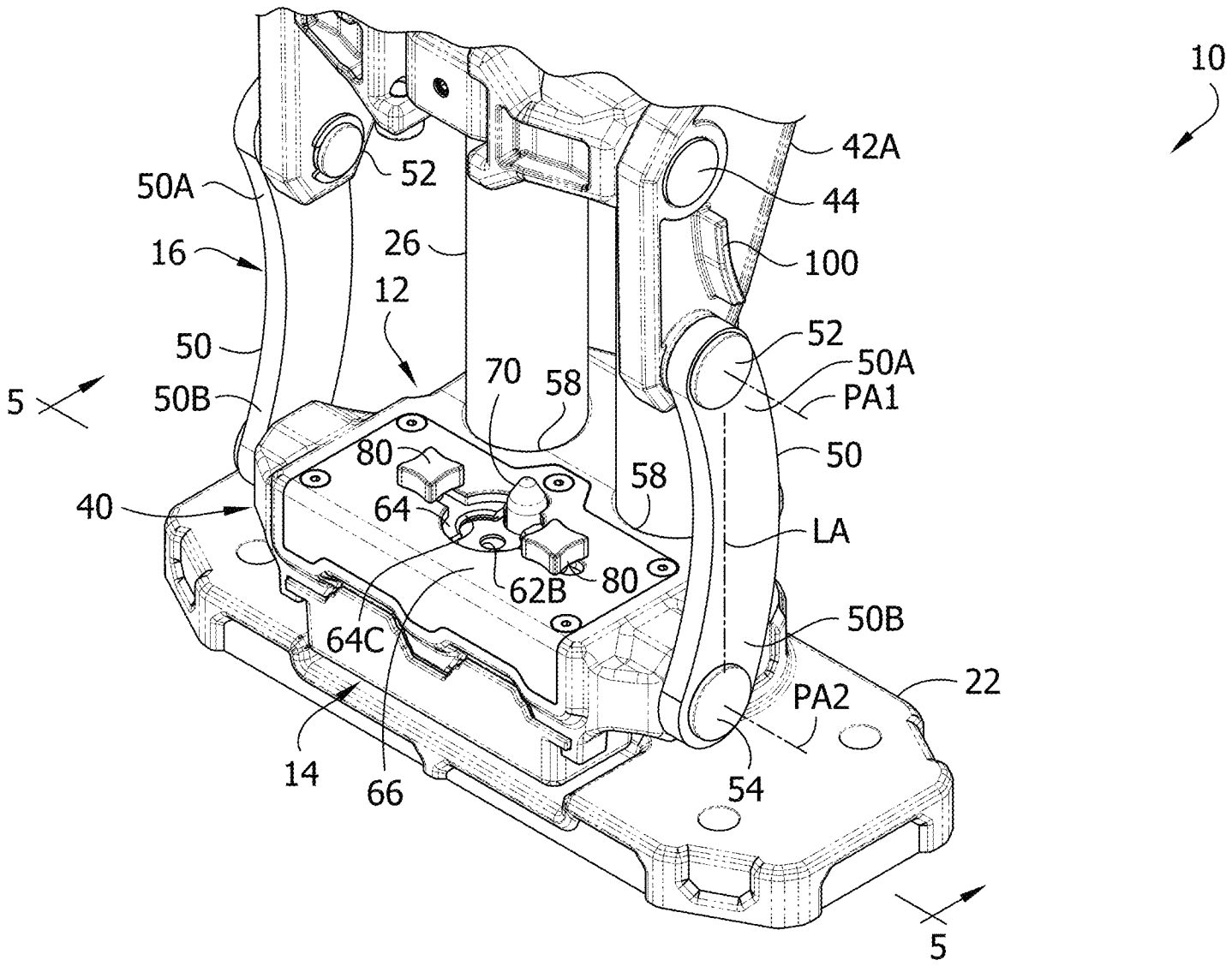
FIG. 3 is an enlarged fragmentary perspective of the reloading press in the non-actuated configuration.

As shown in FIG. 3, the ram 40 includes two openings 58 through which the columns 26 of the frame 18 extend and which permit the ram to be slid upward and downward on the columns. The columns 26 act as guides to constrain and guide movement of the ram upward and downward in a linear travel path. The longitudinal axes of the columns are parallel with a travel axis TA (FIGS. 13-15) of the ram 40.

Figure 5:
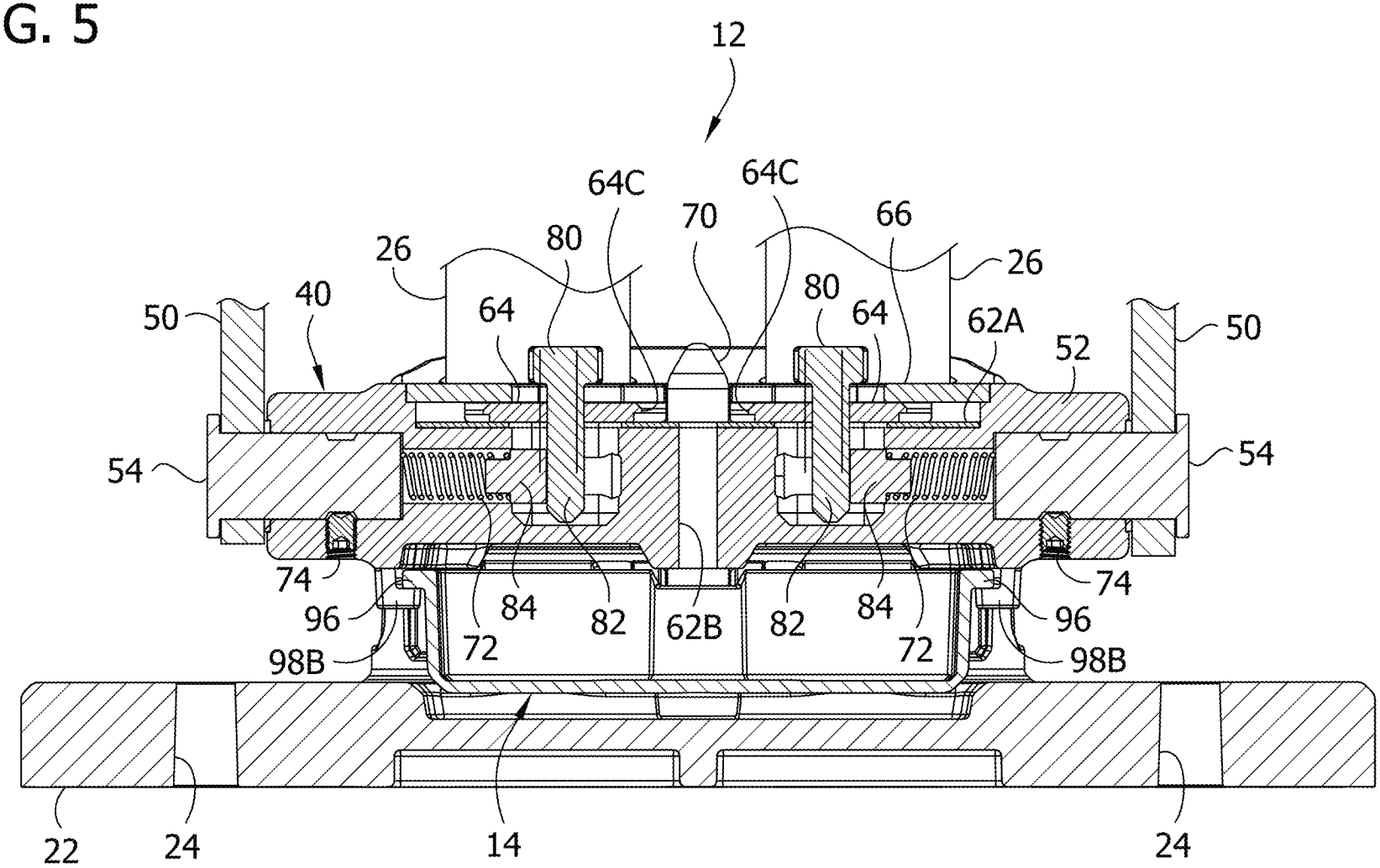
FIG. 5 is a fragmentary section of the press taken in a plane including line 5-5 of FIG. 3.
Figure 6:
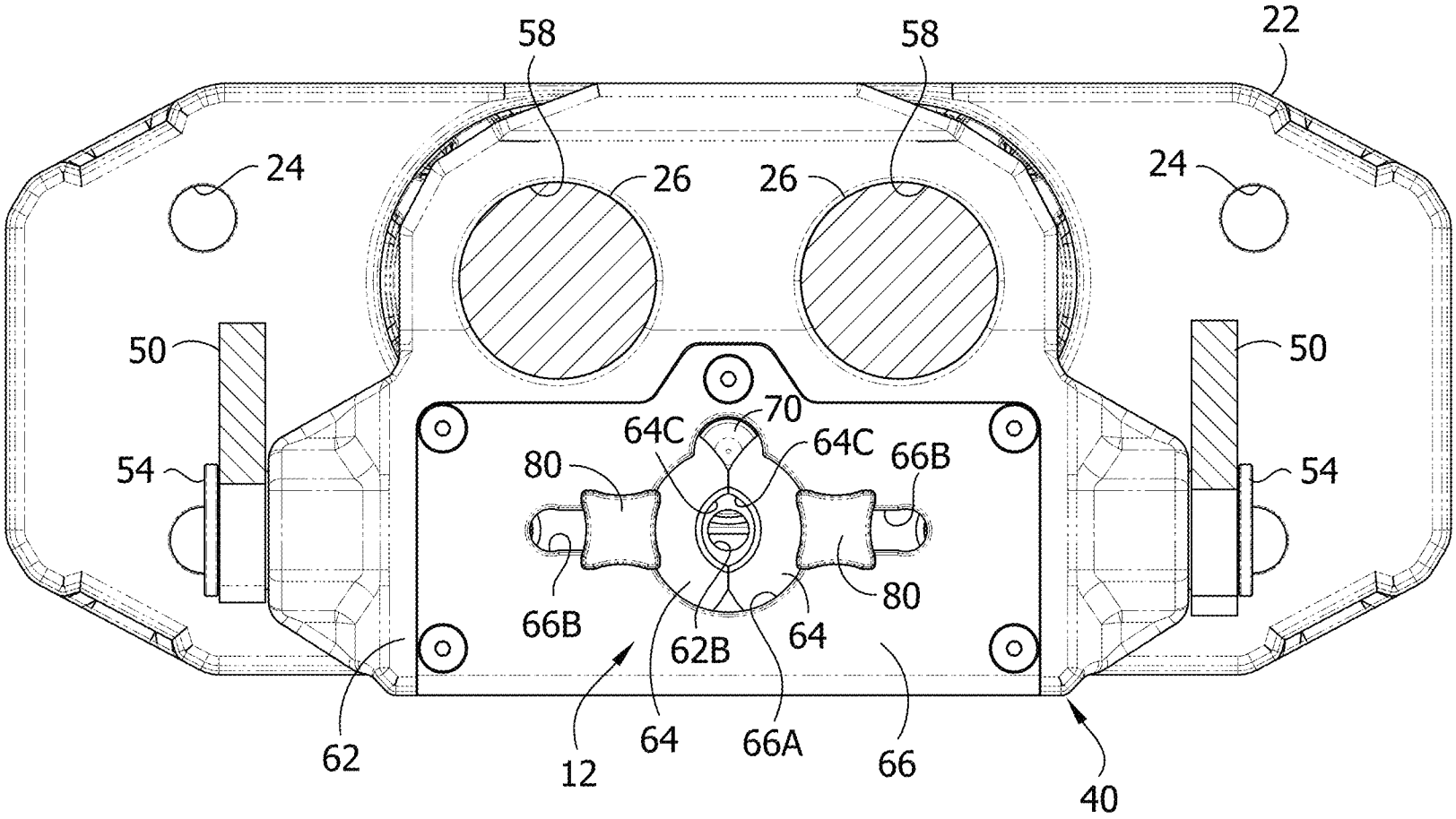
FIG. 6 is a section of the press taken in a plane including line 6-6 of FIG. 4.
Figure 7:
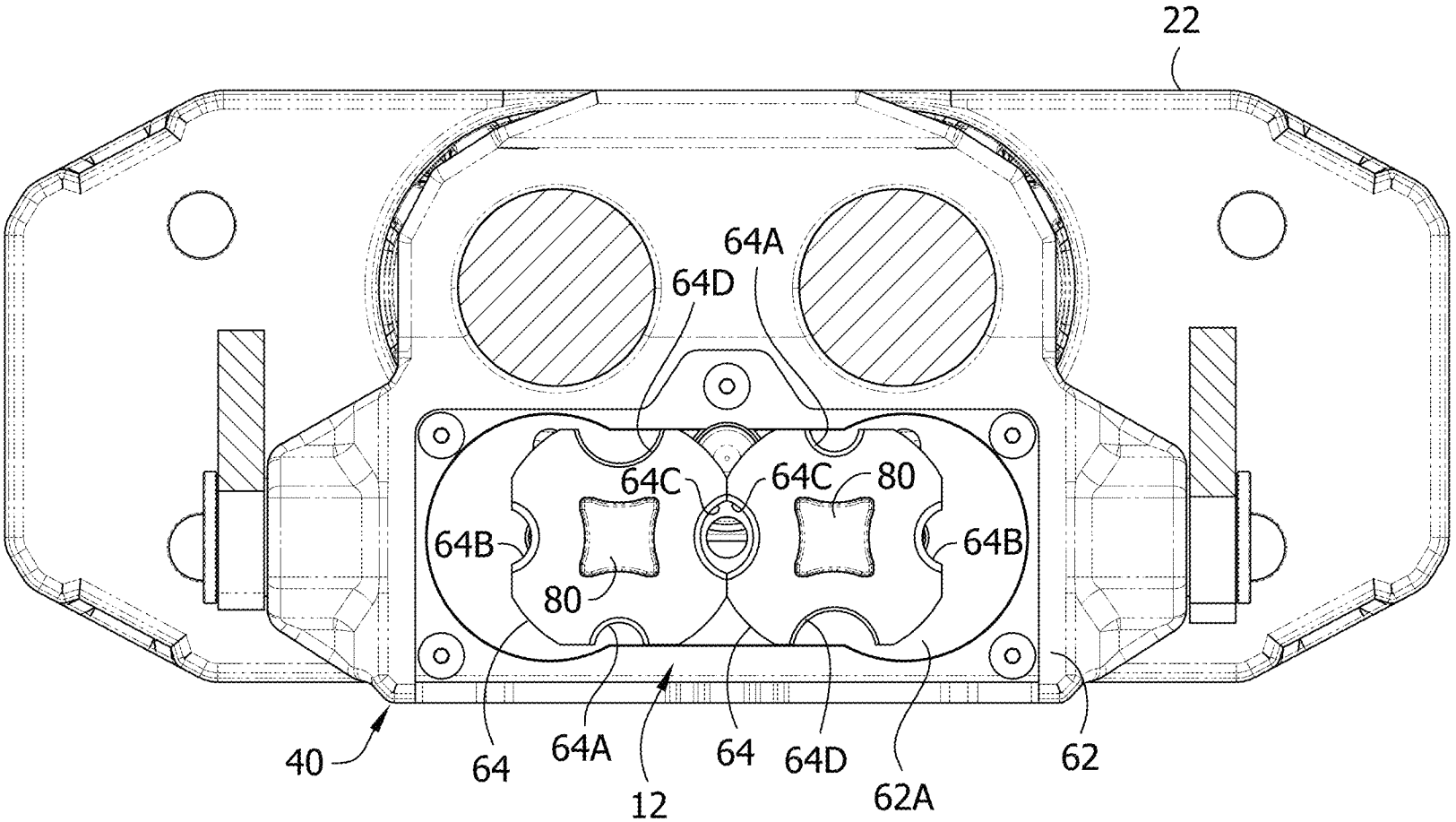
FIG. 7 is a view similar to FIG. 6 but omitting a cover plate over jaws of a case holder.

In the illustrated embodiment, the ram 40 includes the integrated universal case holder 12. Referring to FIGS. 5-9, the ram 40 includes a platform 62 having hubs at opposite sides of the platform configured to receive the pins 54 for making the pin connections with the links 50. The platform 62 defines a bed 62A which cooperates with first and second jaws 64 to form the case holder 12. The bed 62A defines a lower wall of an upper recess in the platform 62 in which the two jaws 64 are received. The left jaw 64 is received in a left portion of the upper recess, and the right jaw is received in a right portion of the upper recess. A cover 66 is fastened by screws onto the platform 62 to cover the upper recess and upper surfaces of the jaws 64. As shown in FIG. 6, the cover 66 includes a central opening 66A and slots 66B extending to the left and right from the central opening.

Figure 4:
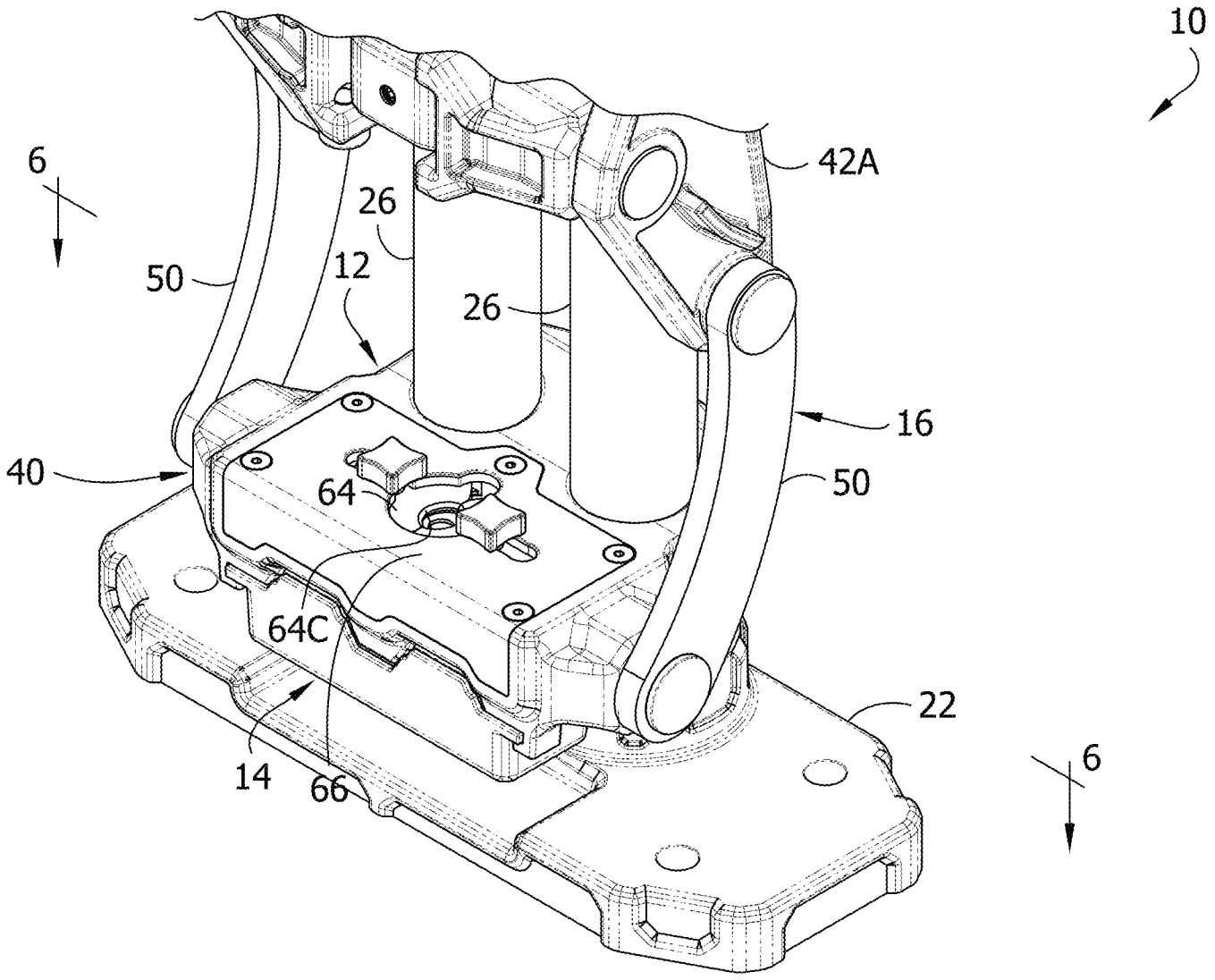
FIG. 4 is an enlarged fragmentary perspective of the reloading press similar to FIG. 3 but showing the press in a partially actuated configuration.

The jaws 64 are configured to automatically grip an ammunition case at a circumferential groove of the case near the primer end of the case. As shown in FIGS. 3 and 5, when the ram 40 is in the home position, a rod 70 extending upward from the base 22 extends through an opening in the platform 62 and separates the jaws 64 from each other. The jaws 64 are biased toward each other by respective springs 72 (FIG. 5), but in the home position the rod 70 separates the jaws from each other. The springs 72 have outer ends in engagement with the pins 54, which are held in position by set screws 74 in the hubs of the platform 62. The rod 70 separating the jaws 64 provides a gap between the jaws to permit a user to conveniently set a primer end of an ammunition case on the bed 62A to be gripped by the jaws. As shown by comparison of FIGS. 3 and 4, as the ram 40 moves upward away from the home position, the ram moves upward away from the rod 70 such that the springs 72 are permitted to move the jaws 64 toward each other. It will be appreciated that if an ammunition case (not shown) were supported on the bed 62A when the springs 72 move the jaws 64 toward each other, engagement of the jaws with the case would limit movement of the jaws toward each other. In particular, a pair of the jaw members 64C (FIG. 7) of the jaws 64 would grip the ammunition case at a circumferential groove of the case. More specifically, the jaw members 64A-64D each comprise an arcuate edge sized and shaped to generally correspond to the curved circumferential groove around an ammunition case of a particular size or range of sizes. This engagement of a pair of the jaw members 64A-64D with the ammunition case holds the case in positon on the ram 40 as the case is moved upward, engaged with the die, and then moved downward. The jaws 64 in the circumferential groove assist in pulling the case away from the die after the case has been pressed against the die. As the ram 40 approaches the home position, the tapered distal end of the rod 70 enters the small gap between the jaws 64 and causes the jaw members to move away from each other against the bias of the springs 72. The ammunition case is thus automatically released by the case holder 12 in the home position, and the user can remove the case from the bed 62A and place the next case on the bed.

The jaws 64 include the plurality of jaws members 64A-64D for use with ammunition cases of different sizes. Each jaw member 64A-64D includes an arcuate edge configured to be received in the circumferential groove of the case. The user can select which pair of jaw members 64A-64D is appropriate for use with the particular ammunition case based on the diameter of the case and the jaw members having the arcuate edge most closely conforming to the circumferential groove of the case. The jaws 64 include the small jaw members 64A for cases of small diameters, medium jaw members 64B for cases of medium diameters, large jaw members 64C for cases of large diameters, and extra-large jaw members 64D for cases of even larger diameters. The user can orient the proper set of jaw members 64A-64D for gripping an ammunition case without using any tools and without disassembling the case holder 12. Handles or knobs 80 connected to each jaw 64 are located above the cover 66. Referring to FIG. 5, pins 82 extend downward from the handles 80 through openings in the jaws 64. Lower ends of the pins 82 are in engagement with plungers 84 at inner ends of the springs 72. Outer ends of the springs 72 are opposed by the pins 54 for biasing the jaws 64 toward the operational positions. The pins 82 define pivot axes about which the jaws 64 are pivotable or rotatable. The pins 82 can form an interference fit with the jaws 64 such that the jaws turn conjointly with the handles 80.

Figure 8:
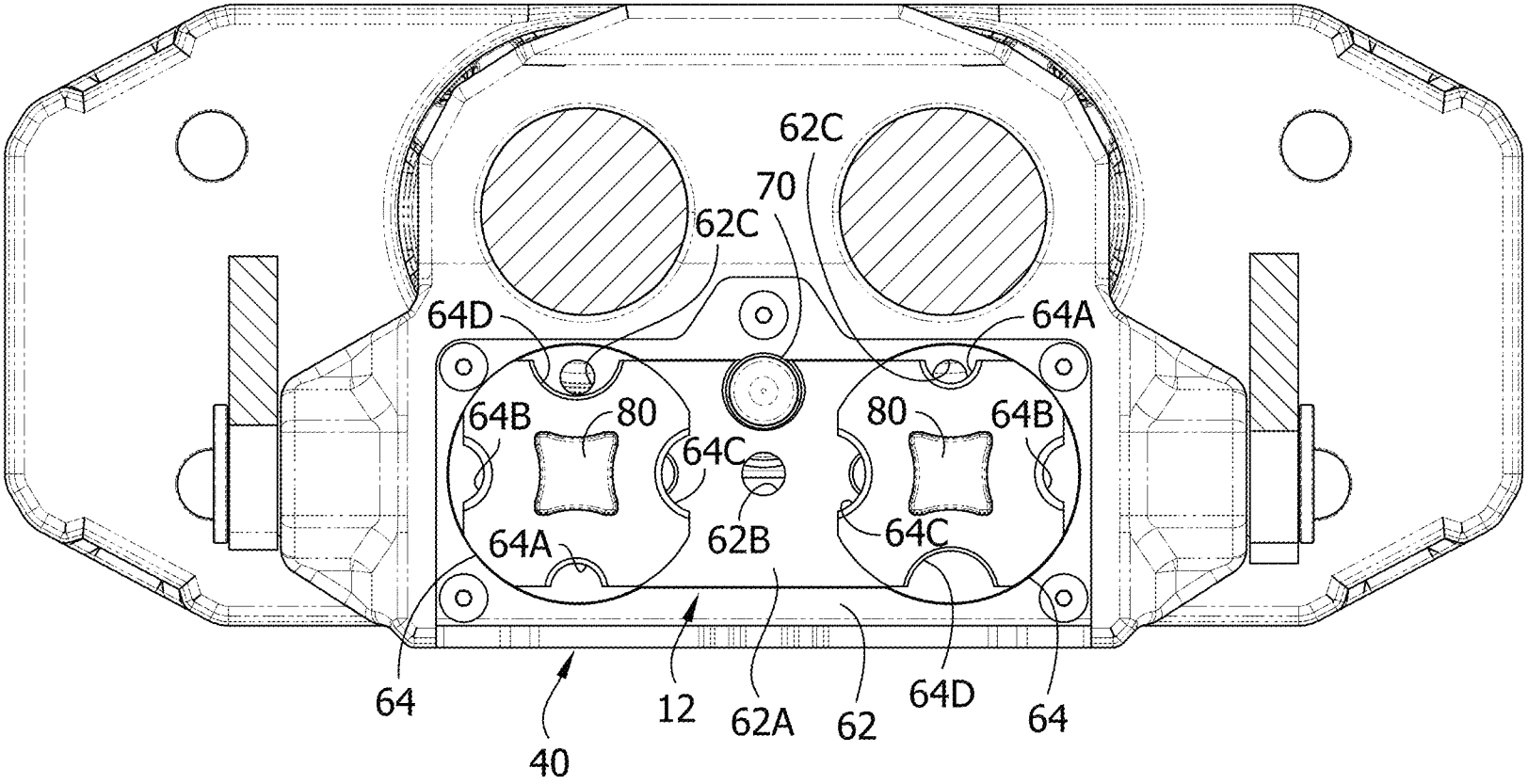
FIG. 8 is a view similar to FIG. 7 but showing the jaws in a retracted position.
Figure 9:
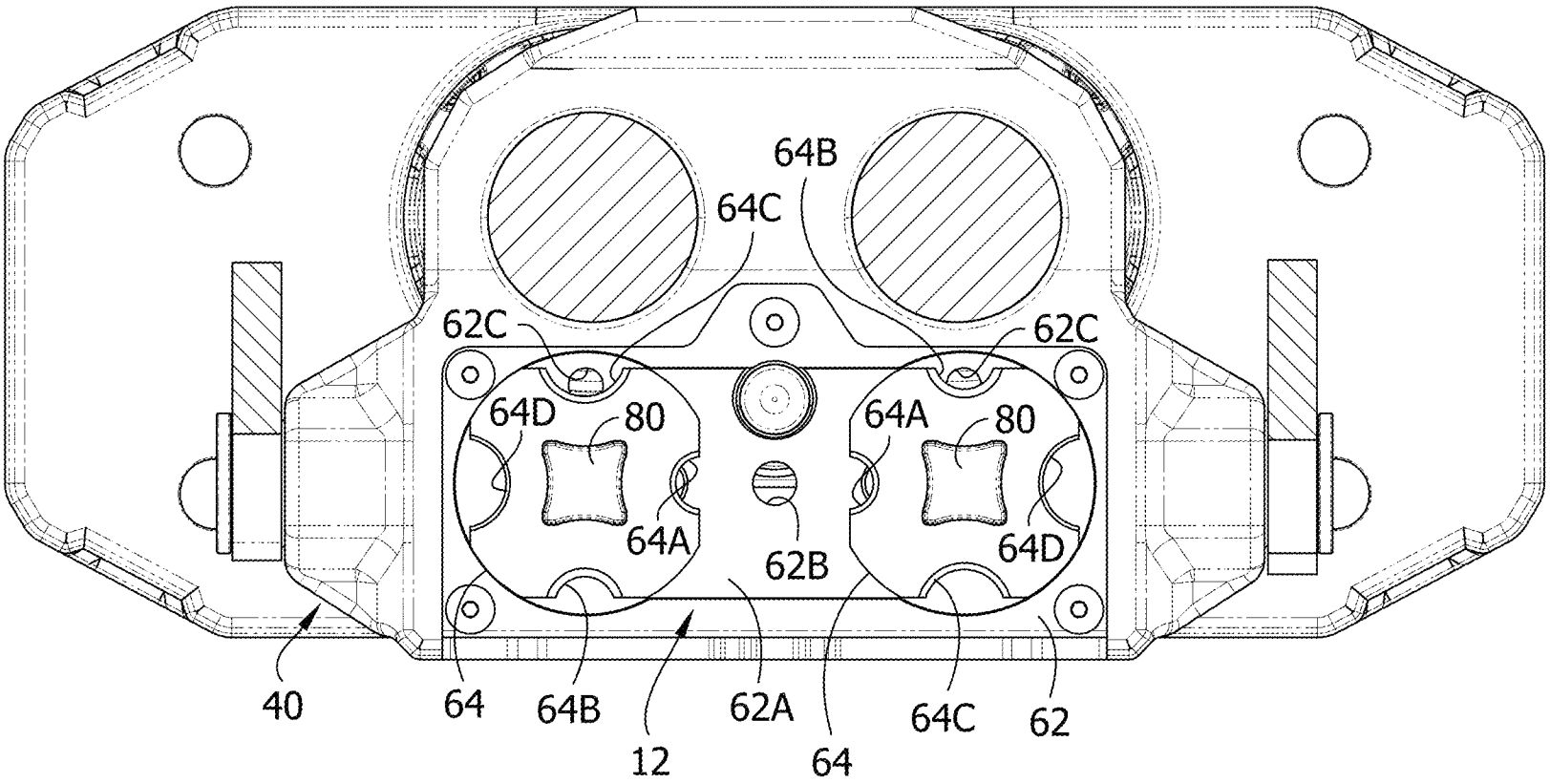
FIG. 9 is a view similar to FIG. 8 but showing the jaws rotated 90 degrees.

To change which jaw member 64A-64D of a jaw 64 is oriented to engage the case, the user grips the handle 80 of a jaw and moves the jaw against the bias of the respective spring 72 away from its operational position (e.g., FIG. 7) to a retracted position (FIG. 8). In the operational position, engagement of the jaw 64 with side walls of the bed recess prevent the jaw from turning. In the retracted position, the jaw 64 is in a segment of the recess having a circular side wall of sufficient diameter to provide clearance for the jaw to turn freely upon rotation of the knob 80 by the user. Accordingly, the user can rotate the jaw 64 to position the proper jaw member 64A-64D for engaging the ammunition case to be held in the case holder 12. The process is repeated for the opposite jaw 64. As shown by comparison of FIGS. 8 and 9, the jaws have been turned to orient the jaw members 64C for gripping a case. When the knobs 80 are released by the user, the springs 72 move the jaws 64 back to their operational positions. Accordingly, the universal case holder 12 is quickly and conveniently changed to effectively hold ammunition cases of most or all diameters.

Figure 10:
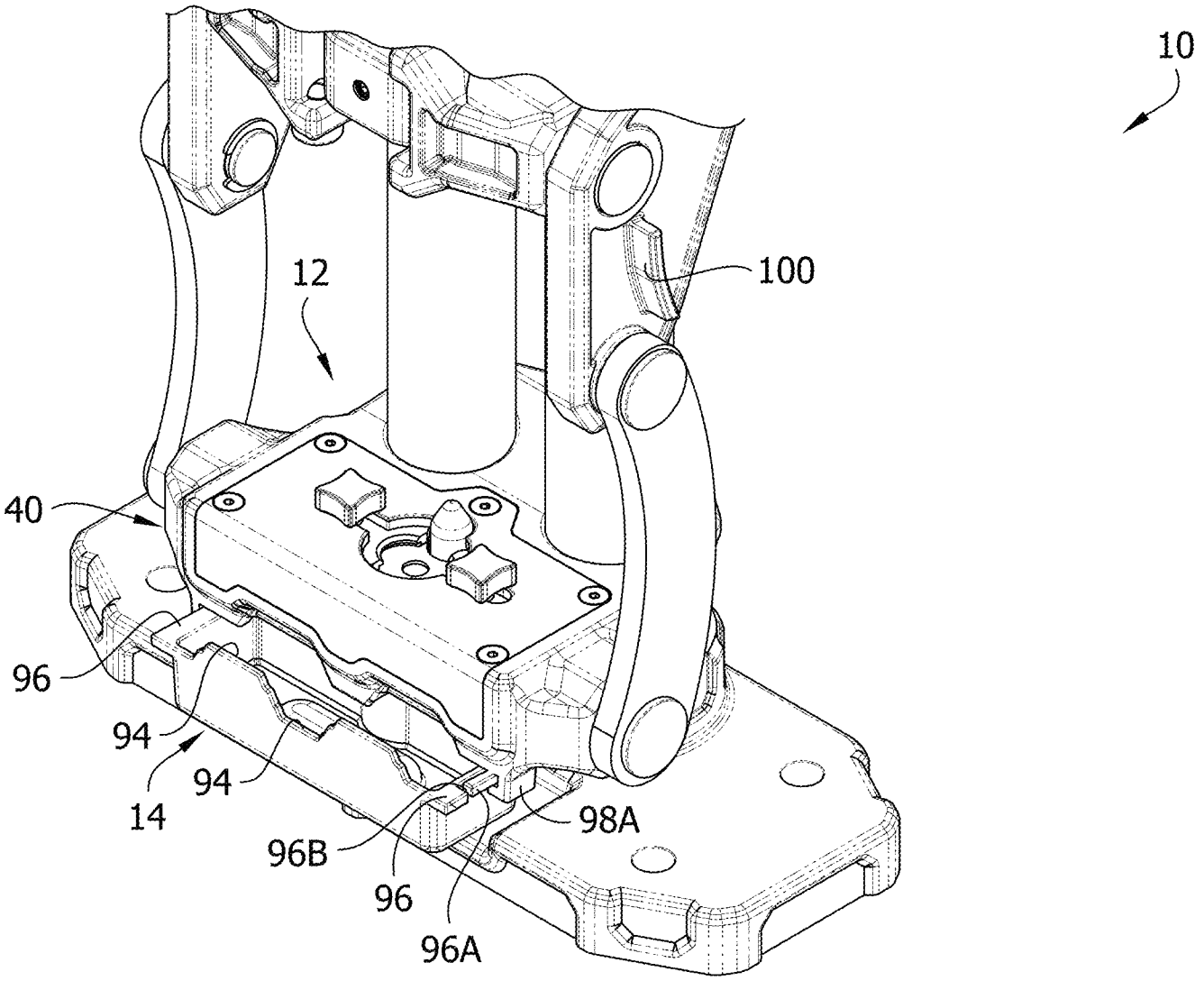
FIG. 10 is a view similar to FIG. 3 but showing a catch tray moved forward.
Figure 11:
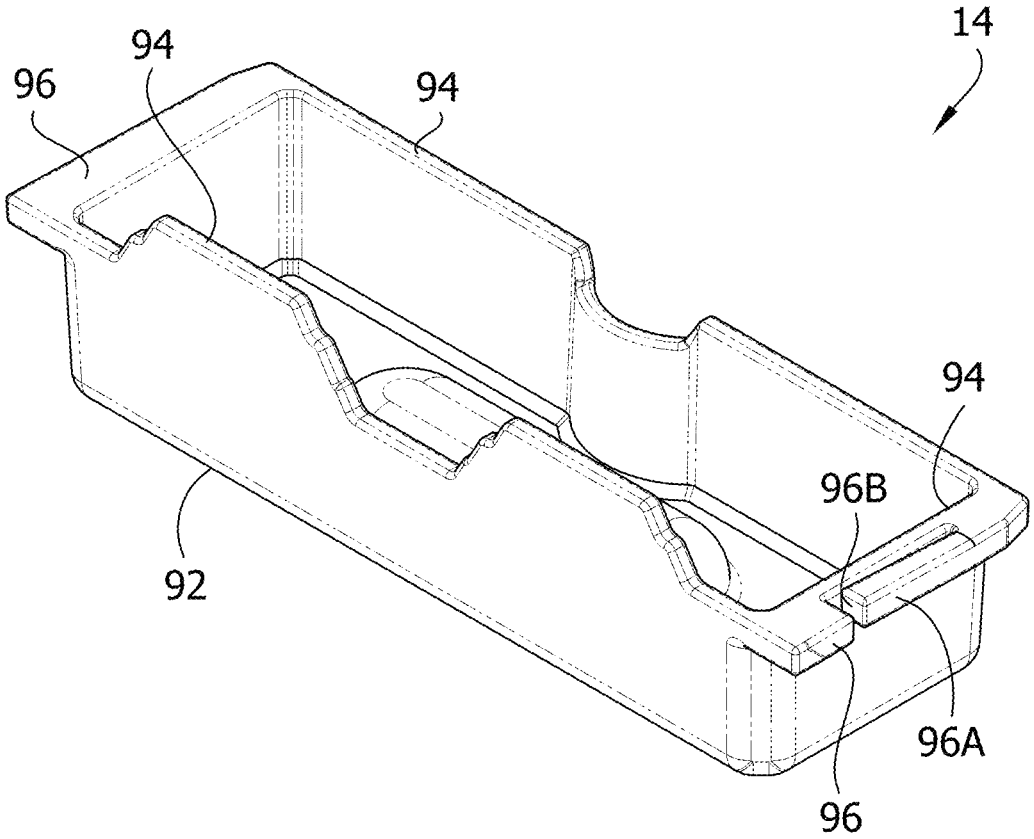
FIG. 11 is a perspective of the catch tray.

In another aspect of the press 10, the spent primer catch tray 14 is carried by the ram 40 for collecting spent primers ejected from ammunition cases. If a decapping die is held by the die holder 30, the pin will be received in the mouth end of the ammunition case as the ram 40 moves the case toward the die. The case will be moved sufficiently toward the die such that the pin forces the spent primer out of the primer end of the case. The platform 62 includes a primer opening 62B positioned to permit the spent primer to be pushed out of the case while the case is resting on the bed 62A and is gripped by the jaws 64. An ejected primer falls through the primer opening 62B into the spent primer catch tray 14. The catch tray 14 has an interior sized to collect several spent primers and can be periodically emptied. In the illustrated embodiment, the primer catch tray 14 is supported by the ram 40 to act like a drawer in sliding into an operational position on the ram where the catch tray is held to collect primers. As shown in FIG. 11, the catch tray 14 includes a body 92 having an upper opening and a rim 94 extending around the upper opening. The catch tray 14 includes two flanges 96 on opposite left and right sides of the tray. Referring to FIGS. 5 and 10, the flanges 96 are configured to be held by slide rails on the bottom of the ram 40. The ram 40 includes front and rear slide rail segments 98A, 98B on the left and right sides. The right flange 96 of the catch tray 14 defines an upwardly extending retainer 96A configured to engage the ram 40 above the front right slide rail 98A when the catch tray 14 is slid into the operational positon on the ram 40. Frictional engagement of the retainer 96A with the ram 40 prevents the catch tray 14 from inadvertently sliding out of the operational position. A user can overcome the retaining frictional force by pulling the tray 14 to slide the tray forward (e.g., FIG. 10). The tray 14 can be fully removed, dumped, and then replaced on the ram 40.

It will be appreciated that when the tray 14 is in the operational position, the tray is relatively tight to the bottom of the ram 40 such that the ram covers the open top of the tray. The closer the rim 94 of the tray 14 is to the ram 40, the better job the ram will do of covering the open top. Covering the open top helps to capture spent primers and other debris in the tray. In the illustrated embodiment, the front portion of the peripheral rim 94 of the tray 14 is configured to be very close to the ram 40. However, portions of the peripheral rim 94, or all of the peripheral rim can be spaced from the ram 40, yet the open top still be effectively covered by the ram, without departing from the scope of the present invention. In the illustrated embodiment, the peripheral rim 94 engages the bottom of the ram 40 in some locations and is spaced from the bottom of the ram in other locations (e.g., rear side of the tray 14). Moreover, it will be appreciated that the tray 14 can include a cover (not shown) covering part of the open top of the tray body yet still have an upper opening (e.g., opening through the cover).

Referring to FIG. 8, when the jaws 64 are moved to the retracted positions, debris openings 62C in the bed 62A are uncovered. If debris happens to collect on the bed 62A, the debris can be "swept" by rotation of the jaws 64 such that the debris falls through the debris openings 62C so the debris does not obstruct movement of the jaws.

The adjustability of the press 10 to provide the user with the sensation of "cam over" or not when the lever 42 is in the actuated position will now be described in further detail. In the illustrated embodiment, the linkage 16 of the ammunition case drive assembly 20, and more particularly the left and right links 50, are adjustable to change whether the press 10 cams over or not. Some users find it desirable to feel a press cam over at the actuated position of the lever, and other users prefer the press to not cam over. The adjustability of the press 10 permits users to select from a cam-over mode and a non-cam-over mode to suit their preference.

Figure 13:
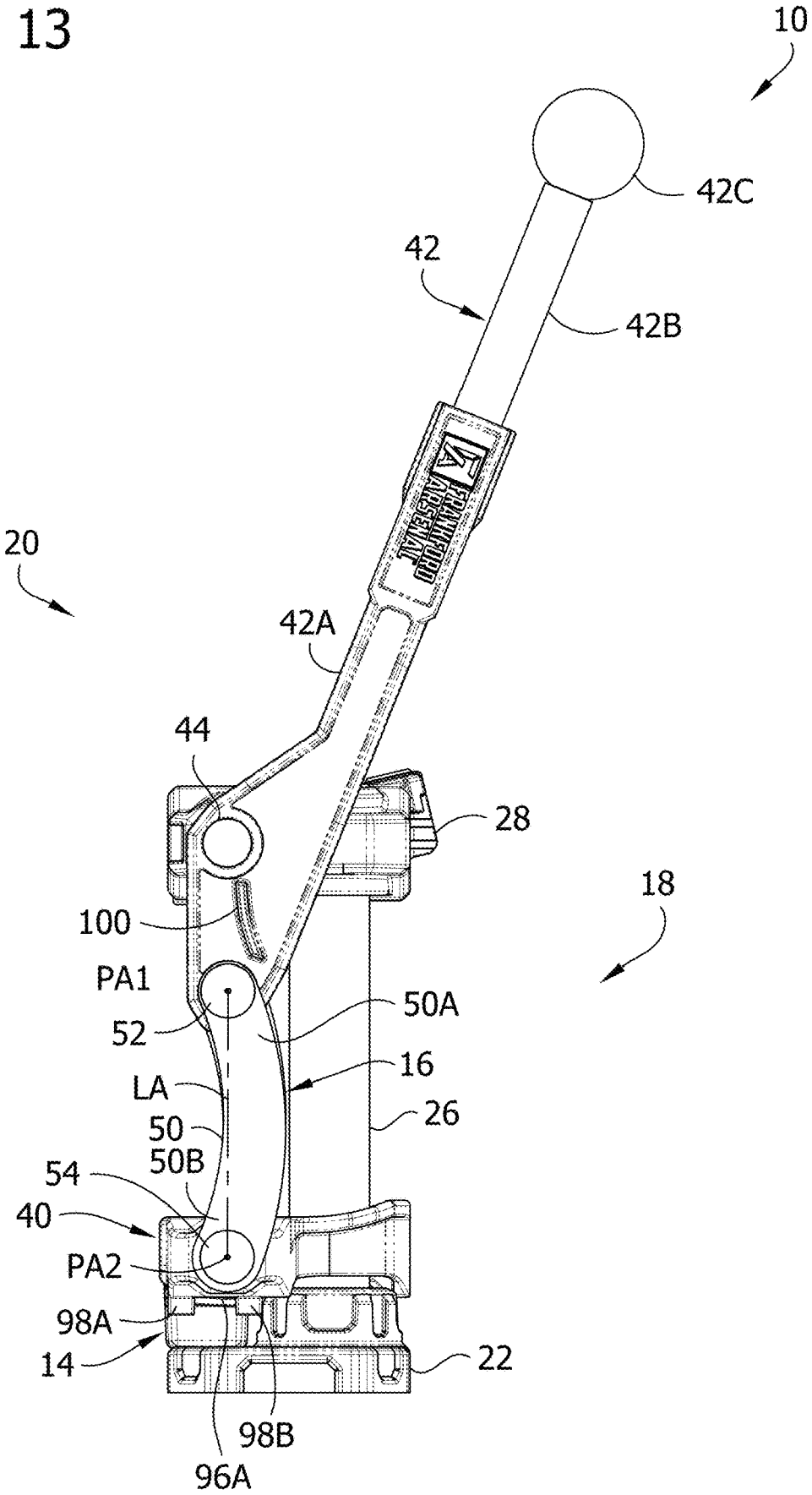
FIG. 13 is a side elevation of the press in the non-actuated configuration.
Figure 14:
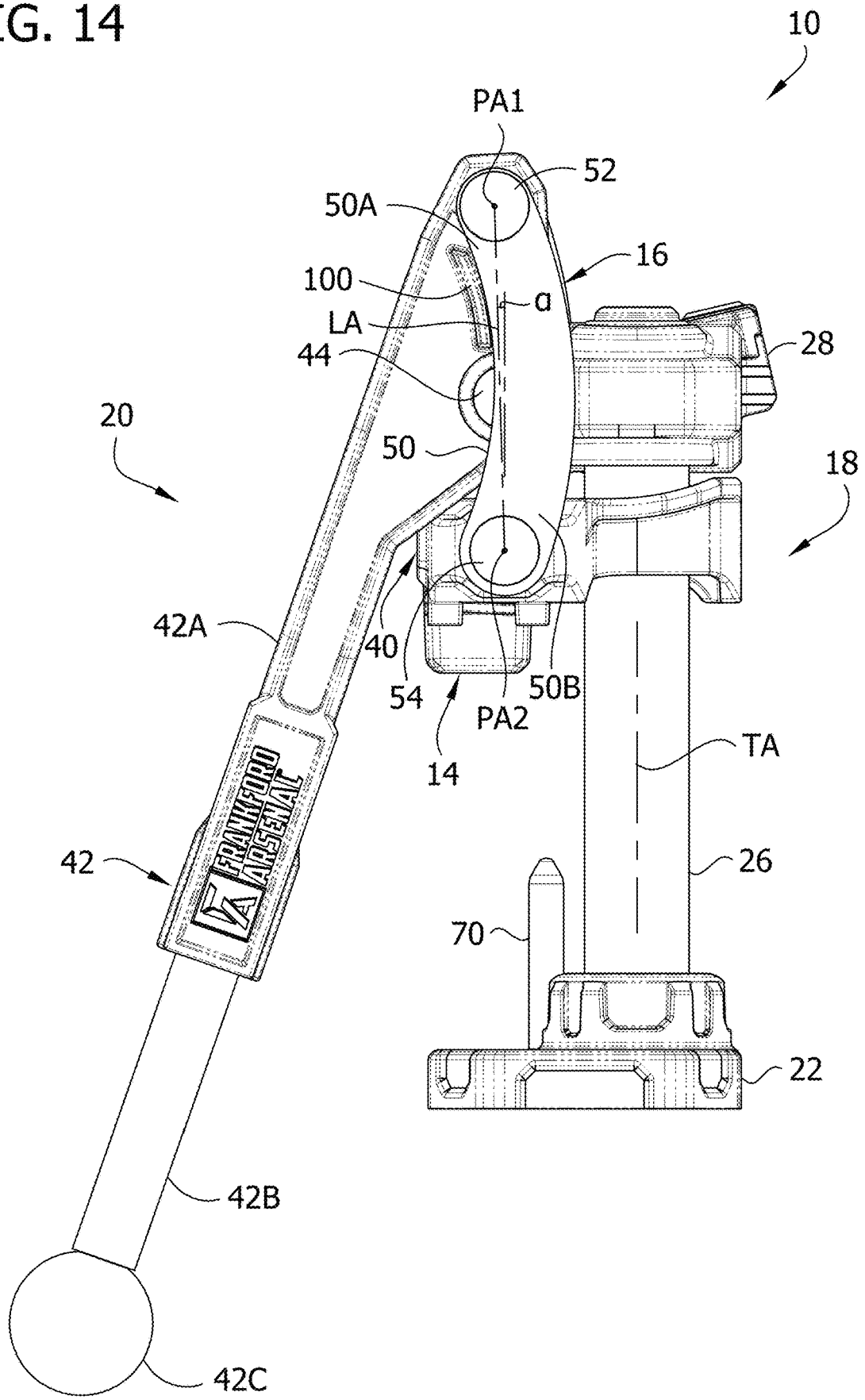
FIG. 14 is a side elevation of the press in a cam-over actuated configuration.

As shown in FIG. 1, stops 100 are provided on opposite sides of the yoke 42A for defining the actuated position in which the lever 42 is prevented from pivoting further in the actuating direction. Only the stop 100 on the right of the yoke 42A is shown, but it will be understood a similar stop is provided on the left side of the yoke 42A. For example, the yoke 42A can be formed of cast iron, and the stops 100 can be formed as the same piece of cast iron as the yoke. As shown in FIGS. 2 and 14, the stops 100 are located to engage the end portions 50A of the links 50 when the lever is pivoted fully downward. When the stops 100 engage the end portions 50A of the links 50, the lever 42 is prevented from pivoting further downward. The shape of the upper end portion 50A in FIG. 13 is chosen to permit sufficient travel of the lever 42, to provide the cam over sensation to the user, before the stop 100 contacts the upper end portion. The cam over sensation is caused by the ram 40 reaching its maximum upward travel and then moving downward slightly at the end of the stroke of the lever. As the user moves the lever 42 toward the actuated position, the user needs to apply pressure to the lever to overcome the resistance of the case against the die. The cam over sensation provides the user with the feeling of force being released at the end of the lever stroke. The force is released because at the end of the stroke, the ram 40 moves downward slightly as the link axis LA moves past parallel (e.g., to an angle $\alpha$ in the inclusive range of about 1 degree to about 15 degrees, such as about 3 degrees) with respect to the linear travel axis TA. The pivot axis of the pins 44 temporarily moves into alignment with the pivot axes PA1, PA2 along link axis LA and then moves "over center" past the link axis LA.

Figure 15:
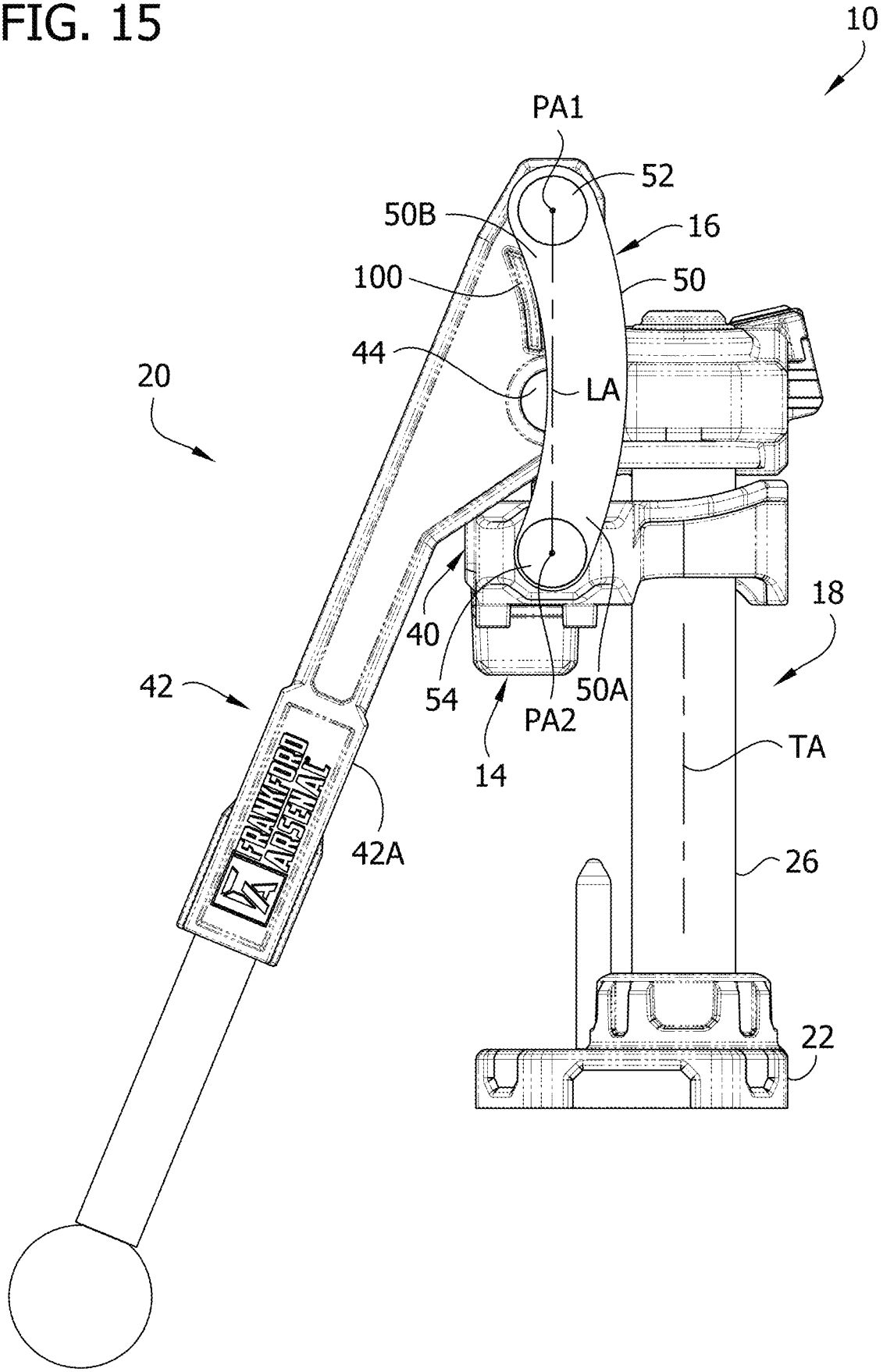
FIG. 15 is a side elevation of the press in a non-cam-over actuated configuration and having the linkage arm reversed relative to FIGS. 13 and 14.
Figure 16:
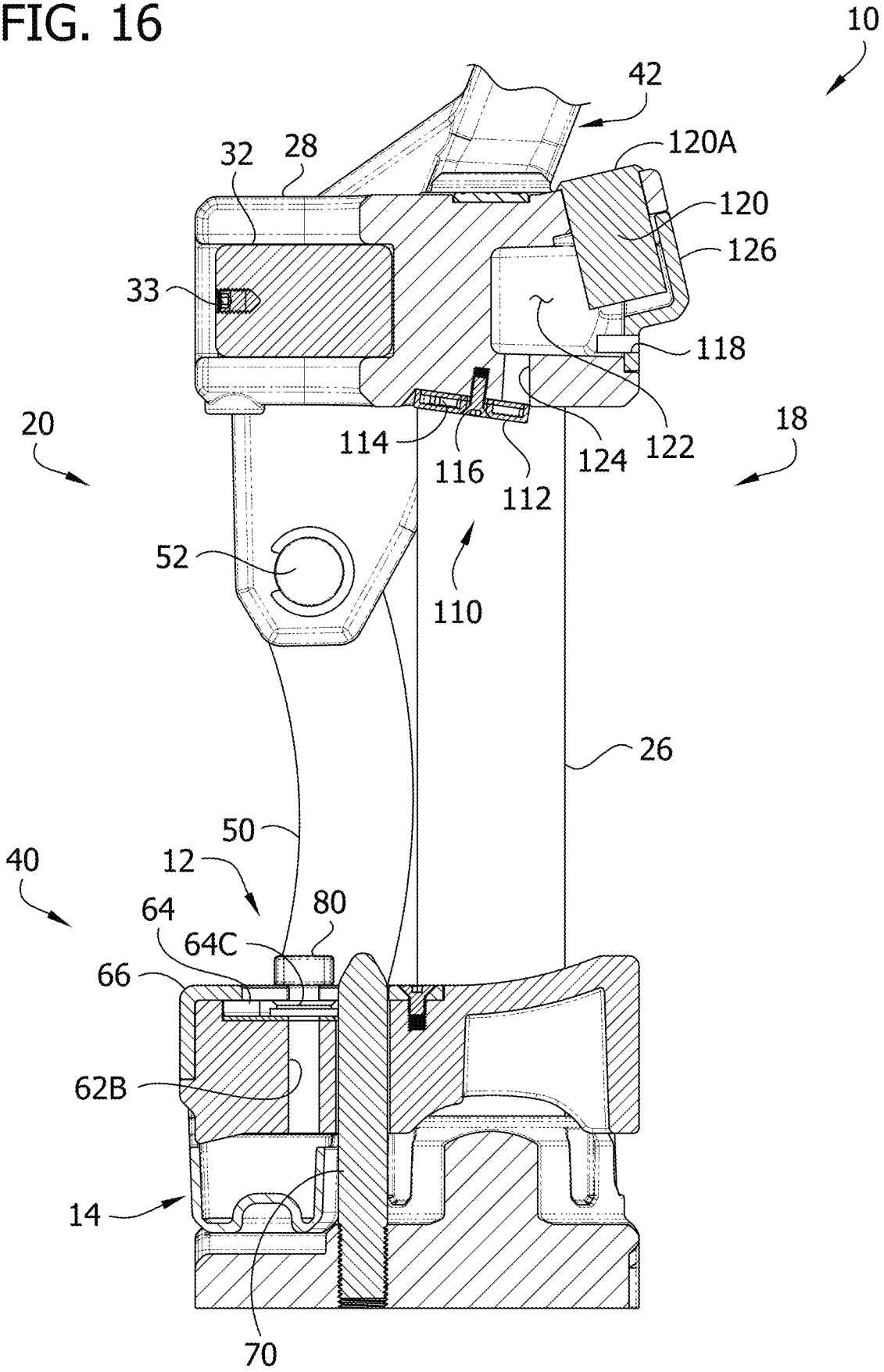
FIG. 16 is a section of the press taken in a plane including line 16-16 of FIG. 1.

To change the configuration from the cam-over mode to the non-cam-over mode, the left and right links 50 are inverted. The pins 52, 54 are removed to disconnect the pin connections. The links 50 are then inverted to position the upper end portions 50A where the lower end portions 50B were previously. The pins 52, 54 are then reinstalled to form the pin connections at the opposite end portions 50A, 50B of the links 50. As shown in FIG. 15, the result is that the stops 100 on the yoke 42A engage the links 50 at the end portions 50B (instead of the end portions 50A), and because of the size and shape of the end portions 50B, the stops engage the links earlier in the downward stroke of the lever. Accordingly, in the actuated position of the lever 42, force has not been released as in the cam-over mode, and the user does not experience the sensation of camming over. In the non-cam-over mode, the link axis LA desirably does not move past parallel with respect to the travel axis TA. For example, as shown in FIG. 15, in the actuated position, the link axis LA is oriented generally parallel to the travel axis TA of the ram 40. It will be appreciated that in the actuated position, the link axis LA may not pivot all the way to a parallel relationship with the travel axis TA.

In another aspect of the press 10, a light assembly 110 is provided on the head 28 of the frame 18 and can be used to illuminate the case holder 12. The light assembly 110 includes a light unit 112 comprising at least one LED 114 (broadly, "light emitting element" or "light source") and is secured to an underside of the head 28 by a fastener 116 (e.g., bolt). The light assembly 110 includes a power port 118 (e.g., USB or micro USB port) for powering the light unit via a cord (not shown) plugged into a power outlet or other power supply (e.g., battery) and plugged into the power port. Alternatively, or in addition, the press could include a battery compartment (not shown) for housing a battery. The power port 118 is electrically connected by appropriate wiring (not shown) to a switch 120, which is electrically connected by appropriate wiring (not shown) to the light unit 112. In the illustrated embodiment, the switch 120 comprises a toggle push button 120A having an on position for powering the light unit 112 and an off position for turning the light unit off. A cavity 122 is provided in the head 28 of the frame 18 for receiving of the power port 118 and the switch 120. A passage 124 in the head 28 extends from the cavity 122 to the rear of the light unit 112 for wiring to be routed in a hidden manner to the light unit. The light unit 112 is mounted to aim the LED 114 forward at an angle to illuminate the case holder 12. A rear cover 126 is provided to cover an opening of the cavity 122 on the rear of the head 28. For example, the cover 126 can be secured to the head by suitable fasteners such as screws or bolts. Accordingly, the light assembly 110 is integrated with the press.

It will be apparent that modifications and variations are possible without departing from the scope of the invention defined in the appended claims. For example, the press could be configured such that the case holder remains stationary while the die holder is moved by the driver toward the case holder. In such a configuration, the driver may have an arrangement as shown herein but the location of the die holder on the frame and the case holder on the ram be swapped. Alternatively, the driver could be configured to move an upper die holder downward to a stationary lower case holder. Moreover, the die holder and the case holder may move toward each other.

As various changes could be made in the above constructions and methods without departing from the scope of the invention, it is intended that all matter contained in the above description and shown in the accompanying drawings shall be interpreted as illustrative and not in a limiting sense.

What is claimed is:

1. An ammunition press comprising:

a frame configured to engage a support surface to support the ammunition press on the support surface;

a die holder configured to hold a die for performing an operation on an ammunition case, the die holder configured to be supported by the frame;

a case holder configured to hold the ammunition case, the case holder configured to be supported by the frame;

a press actuator configured to decrease a distance between the die holder and the case holder to perform the operation on the ammunition case; and a light assembly supported by the frame, the light assembly including a light unit configured to illuminate a case working zone between the die holder and the case holder and a threaded fastener securing the light unit to the frame.

2. The ammunition press of claim 1, wherein the frame includes a recess, the light unit being disposed in the recess.

3. The ammunition press of claim 2, wherein the frame includes a base configured to engage the support surface to support the ammunition press on the support surface and a head configured to support the die holder, wherein the head includes the recess.

4. The ammunition press of claim 2, wherein the recess is a first recess, wherein the frame includes a second recess, the light assembly including an actuator configured to turn the light unit on and off, the actuator being disposed in the second recess.

5. The ammunition press of claim 4, wherein the light assembly includes electrical circuitry electrically connecting the light unit and the actuator, the electrical circuitry being housed within the frame.

6. The ammunition press of claim 5, wherein the frame includes a passage extending between the first and second recesses, the electrical circuitry being disposed in the passage.

7. The ammunition press of claim 1, wherein the frame includes a head configured to support the die holder, the light unit being mounted to an underside of the head.

8. The ammunition press of claim 1, wherein the light unit is arranged to direct light at an angle to the vertical and the horizontal.

9. The ammunition press of claim 1, wherein the light unit is arranged to direct light at a forward angle to illuminate the case working zone.

10. The ammunition press of claim 1, wherein the light unit is arranged to illuminate the case holder.

11. The ammunition press of claim 1, wherein the light unit comprises a light emitting diode (LED).

12. The ammunition press of claim 1, wherein the frame includes a passage configured to rout wiring to the light unit, the light unit underlying the passage.

13. The ammunition press of claim 1, wherein the frame has an interior space, the light unit being disposed in the interior space.

14. The ammunition press of claim 13, wherein the frame includes a head configured to support the die holder, the head including the interior space.

15. The ammunition press of claim 14, wherein the interior space extends from an underside of the head to a topside of the head.

16. The ammunition press of claim 15, wherein the interior space includes a passage sized to permit wiring to be routed to the light unit.

17. The ammunition press of claim 1, wherein the die holder comprises a receiver configured to receive a collar coupleable to the die.

18. The ammunition press of claim 17, in combination with the collar.

* * * * *